United States Patent [19]

Person et al.

[11] Patent Number: 4,700,519

[45] Date of Patent: Oct. 20, 1987

[54] COMPOSITE FLOOR SYSTEM

[75] Inventors: Joel I. Person, 19 Rosalie Pl., Commack, N.Y. 11725; Atle Gjelsvik, Tappan, N.Y.

[73] Assignee: Joel I. Person, Commack, N.Y.

[21] Appl. No.: 854,112

[22] Filed: Apr. 17, 1986

Related U.S. Application Data

[63] Continuation of Ser. No. 630,965, Jul. 16, 1984, Pat. No. 4,592,184.

[51] Int. Cl.[4] ..... E04B 1/16; E04B 5/19

[52] U.S. Cl. ..... 52/334; 52/338

[58] Field of Search ..... 52/334, 338, 694, 739, 52/693, 434, 435

[56] References Cited

U.S. PATENT DOCUMENTS

| | | | |
|---|---|---|---|
| 16,798 | 11/1927 | Marks | 264/35 |
| 843,843 | 2/1907 | Reavis | 52/739 |
| 1,243,395 | 11/1917 | Smirlski | 52/334 X |
| 1,622,559 | 3/1927 | Zabriskie | 52/694 X |
| 1,657,849 | 1/1928 | Witmer | 52/694 X |
| 1,804,132 | 5/1931 | Tashjian | 52/334 |
| 1,908,663 | 5/1933 | Gentz | 52/250 |
| 1,911,018 | 5/1933 | Goeltz | 52/694 X |
| 1,963,184 | 6/1934 | Webster | 52/691 |
| 2,055,701 | 9/1936 | Palmer | 52/334 X |
| 2,233,054 | 2/1941 | Heeren | 52/435 |
| 2,340,176 | 1/1944 | Aueni et al. | 52/334 |
| 3,177,619 | 4/1965 | Benjamin | 52/334 X |
| 3,183,628 | 5/1965 | Smith | 52/739 X |
| 3,245,186 | 4/1966 | Jentoft | 52/334 |
| 3,362,121 | 1/1968 | Weber | 52/334 |
| 3,394,514 | 7/1968 | Lindner | 52/334 X |
| 3,434,263 | 3/1969 | Beckman et al. | 52/735 X |
| 3,596,421 | 8/1971 | Miller | 52/334 X |
| 4,454,695 | 6/1984 | Person | 52/338 X |

FOREIGN PATENT DOCUMENTS

| | | | |
|---|---|---|---|
| 78158 | 11/1949 | Czechoslovakia | 52/334 |
| 2218573 | 10/1973 | Fed. Rep. of Germany | 52/693 |
| 2239155 | 2/1974 | Fed. Rep. of Germany | 52/693 |
| 734787 | 8/1932 | France | 52/693 |
| 1008501 | 2/1952 | France | 52/334 |

*Primary Examiner*—Alfred C. Perham

*Attorney, Agent, or Firm*—Amster, Rothstein & Ebenstein

[57] ABSTRACT

A composite floor system includes a plurality of joists, each having a top and bottom chord and a web in the space between the chords. The top chord is formed with a pair of horizontally extending legs and at least one vertical leg. The top of the web is attached to the bottom surface of the top chord. Metal decking is supported by the horizontal legs of the top chord of adjacent joists and a concrete slab is poured on the decking and encloses the vertical leg of the top chord.

6 Claims, 5 Drawing Figures

COMPOSITE FLOOR SYSTEM

This is a continuation of co-pending application Ser. No. 630,965, filed on July 16, 1984, now U.S. Pat. No. 4,592,184 issued June 3, 1986.

DESCRIPTION OF THE INVENTION

This invention relates to a composite floor construction, and more particuarly to a composite open-web steel joist and concrete floor construction for use in the construction of buildings.

In the past, floor construction has used open-web steel joists placed in position spanning structural supports and a concrete slab poured on decking supported by the joists. Generally, an open-web steel joist is a joist in the form of a truss having horizontal top and bottom chords joined by a web comprising tension and compression members triangulating the space between the top and bottom chords.

While the chords may be of many shapes, typically, the top and bottom chords each comprise a pair of steel angle bars, the top chord angle bars being arranged with one leg of each bar extending horizontally outward at the top of the truss, and the other leg of each bar extending downwardly on opposite sides of the web. The bottom chord angle bars are arranged with one leg of each bottom chord angle bar extending horizontally laterally outward at the bottom of the truss, and the other leg of each bottom chord angle bar extending vertically upward on the opposite sides of the web. Decking for supporting the concrete slab is laid on and fastened to the horizontal leg of the top chord angle bars at the top of the joist, and a concrete slab poured on the decking. In this typical construction, there is no structural integration of the concrete slab to the joists, and the slab and joists function as separate entities with the slab constituting dead load on the joists without contributing materially to the strength of the overall structure.

In another construction, the upper ends of the web members project upwardly above the upper horizontal legs of the top chord angle bar for anchorage in the concrete slab to form a composite slab and joist construction in which the slab may, to some extent, become a compression member sharing part of the load. It has been found that this type of construction does not obtain the full potential of a composite slab joist construction, and has certain disadvantages. For example, the effective anchorage is between the slab and the upper ends of the web members so that transfer of stress between the joists and the slab occurs only at the upper ends of the web members. Furthermore, the slab is necessarily placed above the level of the supporting structure for the joists. In addition, the decking is formed with slots to enable the web member to protrude into the concrete forming the composite section. This creates another problem, namely, that the slots must be exactly aligned along the length of the building and the joist must also be perfectly aligned.

One attempt to remedy the problems associated with composite floor constructions is disclosed in U.S. Pat. No. 3,362,121, which describes an open-web steel joist in the form of a trust having a web, a top chord and a bottom chord. The top chord comprises a pair of steel angle bars arranged with one leg of each of the bars extending horizontally outward from a position on the truss below the top of the truss, and the other leg of each bar extending upwardly to the same height on opposite sides of the web and terminaing below the top of the web. Decking is laid on the horizontal legs of the top chord, and concrete is poured on the decking to embed the vertical legs of the top chord angle bars and the upper ends of the web in the concrete slab to create a composite floor structure. In this construction, the the top chord is below the top of the web member and composite action is obtained primarily by embedding the portion of the web extending above the top of the top chord into the concrete slab.

An improvement upon the composite floor system described in U.S. Pat. No. 3,362,121, is described in copending U.S. patent application Ser. No. 342,467 entitled "Composite Floor System". In that composite floor system, the joist used in forming the composite concrete floor system comprises a truss which has a top chord, a bottom chord and a web, including tension and compression members in the space between the top and bottom chords secured to the top and bottom chords. The top chord has a pair of metal bars, each having an angle shape in cross section and each having a vertical leg and a horizontal leg. The vertical leg of one bar extends to a height above the verical leg of the other bar, and the top of the web extends to a point between the tops of the lower vertical leg and the higher vertical leg. The vertical legs of the top chord are spaced from one another to permit concrete when poured, to form the composite floor system, to flow between the vertical legs.

This arrangement has a number of advantages when compared with the composite floor system described in U.S. Pat. No. 3,362,121. For example, for equal strength upper chord made from standard angles, the concrete slab of the composite floor system described in U.S. Pat. No. 3,362,121 will be thicker than a concrete slab of the composite floor system described in U.S. patent application Ser. No. 342,467. In addition, for equal strength upper chord, the eccentricity of the web of the composite floor system described in U.S. Pat. No. 3,362,121 will be greater than the eccentricity of the web of the composite floor system described in U.S. patent application Ser. No. 342,467 creating an undesirably greater bending moment in the upper chord of the joist resulting in the requirement that for a given span and joist spacing, the steel used in the composite floor system of U.S. Pat. No. 3,362,121 must be thicker and the entire joist heavier than that of a comparable joist in the composite floor system of application Ser. No. 342,467. Alternatively, for a given weight of steel, the joists in the composite floor system of application Ser. No. 342,467 could be placed at greater distances apart than the joists in the composite floor system of U.S. Pat. No. 3,362,121 resulting in economy and flexibility in the design of composite floor systems.

While the composite floor system described in U.S. patent application Ser. No. 342,467 was a significant improvement over the composite floor system described in U.S. Pat. No. 3,362,121, it has been found that even further improvement can be made.

Accordingly, it is an object of the invention to further improve composite floor systems and to provide a composite floor system which is easy and economical to erect and provides improved load carrying capacity.

It is further object of the invention to provide a composite floor system including a joist in which the eccentricity of the upper chord is substantially reduced or eliminated.

It is a further object to the invention to provide a joist for a composite floor system in which the top of the chord provides a chair for support of reinforcing mesh used in the concrete slab of the composite floor system.

Still further, it is an object of this invention to provide an improved composite floor system in which the upper chord of the joist has deformations which are embedded in the concrete slab to aid in the composite action of the floor system.

In accordance with the invention, the joist used in forming the composite concrete floor system comprises a truss which has a top chord, a bottom chord and a web, including tension and compression members in the space between the top chord and the bottom chord and secured to the top and bottom chords. The top of the web is secured to the bottom surface of the top chord, thereby substantially eliminating the eccentricity of the top chord. In addition, projections, slots or other concrete engaging means are provided in the portion of the top chord extending into the concrete slab to aid in composite action between the top chord and the concrete slab.

These and other objects and features of the invention will become apparent to a worker skilled in the art when taken in conjunction with the drawings, in which:

FIG. 1 a perspective view of a portion of the composite floor system showing two joists supporting steel decking between the laterally-extending portions of the adjacent top chords and overlaid with a poured concrete slab, a portion of the top chord of one joist being broken away to show the connection between the top of the web and lower surface of the top chord;

Figure 1:
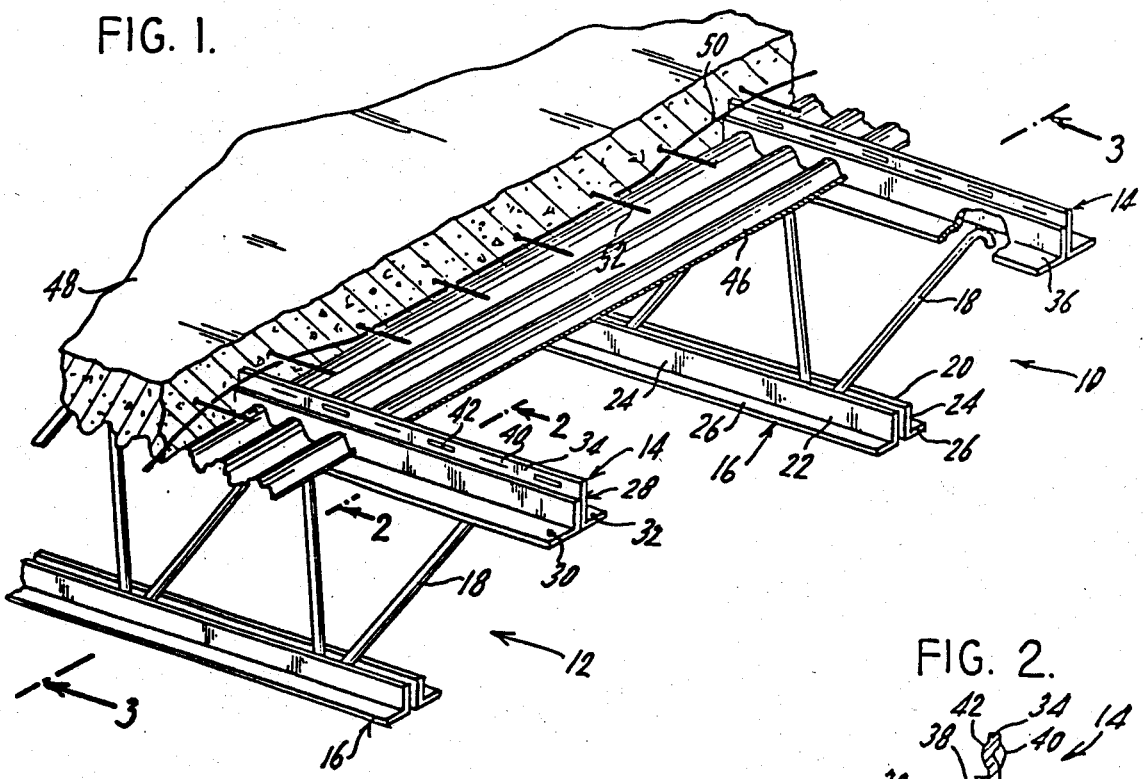
Figure 2:
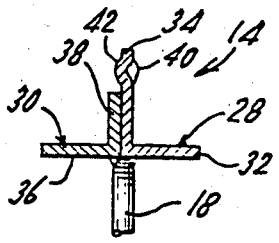
FIG. 2 is a section taken along lines 2—2 of FIG. 1 and looking in the direction of the arrows.
Figure 3:
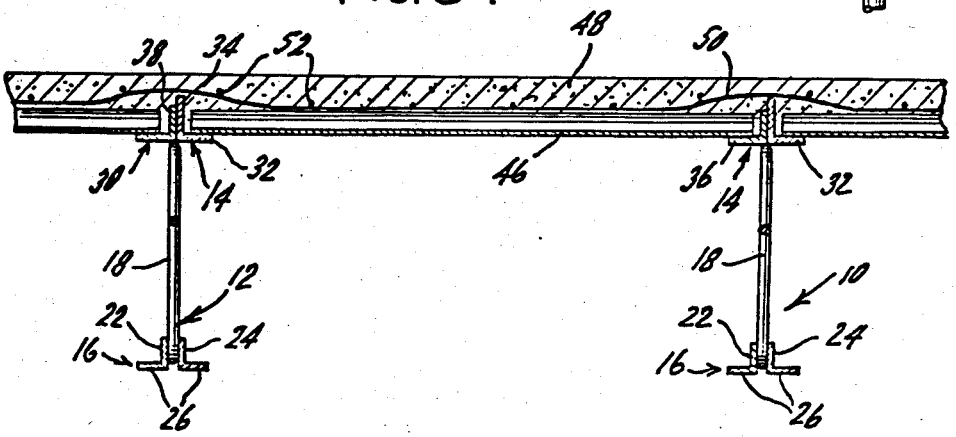
FIG. 3 is a section taken along lines 3—3 of FIG. 1 and looking in the direction of the arrows.

Referring to FIGS. 1 through 3, there is shown a portion of a composite floor system including a pair of identical joists 10, 12, each having a top chord 14, a bottom chord 16, and web 18 comprising tension and compression members in the space between the top and bottom chords. Bottom chord 16 includes two metal bars 20, 22 having an angle shape, each having a vertical leg 24 and a horizontal leg 26; the height of the vertical legs 24 preferably being the same. The vertical legs 24 of the two bars in the bottom chord are spaced apart by the width of web 18 which is secured between the vertical legs 24.

The top chord 14 includes two metal bars 28, 30 having an angle shape. Metal bar 28 has a horizontal leg 32 and a vertical leg 34, and metal bar 30 has a horizontal leg 36 and a vertical leg 38. The top of vertical leg 34 extends above the top of vertical leg 38. Vertical legs 34 and 38 are joined to one another by, for example, welding. As best seen in FIGS. 1 and 2, concrete engaging means such as protrusions 40 and 42 are formed in the opposite faces at spaced intervals along the length of vertical leg 34.

The top surface of web 18 is secured to the bottom surface of top chore 14 by, for example, welding. This configuration substantially reduces or elimiantes the eccentricity normally associated with joists used in composite floors creating, when compared with prior composite floor joists, smaller bending moments in the top chord which permits the use of thinner steel in joists of comparable span and joists spacing or permits joists of equal steel thickness to be placed at greater distances apart. The resultant composite floor system is thus more economical to erect and can be designed with greater flexibility in the placement of joists.

To form a composite floor system, a plurality of spaced joists span the open spaces between two building supports with the lower surfaces of opposite ends of chords 14 positioned on the supports as is well known in the art. Metal decking 46, which is preferably corrugated, as shown, is supported between the horizontal legs 32, 36 of adjacent joists 10, 12 and preferably held in place by welding. A concrete slab 48 which may have reinforcing material 50, 52 is poured over the metal decking. The poured concrete flows over the vertical legs 34, 38 and protrusions 40, 42 of the top chord 14 of each joist to produce an intimate bond between the top chord 14, and the metal decking 42.

The unequal height of the vertical legs of the top chord provides a continuous high chair permitting the reinforcing material to be draped over the supports, thereby allowing a greater proportion of the top chord to be encased with concrete, reducing the possibility of cracks forming along the supports and reducing the width of the concrete slab.

In one particular embodiment of the invention, all joists are designed in accordance with the American Institute of Steel Construction. The top and bottom chord members are formed of hot-rolled angles preferably having a minimum yield stress of steel of 50,000 psi. All web members are designed to equal or exceed Steel Joist Institute specifications. The top chord consists of two angles, one being typically 2 by $1\frac{1}{2}$ inches and the other being typically 2 by $2\frac{1}{2}$ inches. In forming the composite floor system, the joists are typically placed on 5 foot centers. The length of the joists typically range from 10 to 45 feet or more, and are welded or bolted to the building supporting members before the metal deck is placed. The metal decking should be high tensile, uncoated or galvanized steel with the gauge of the steel dependent upon the spacing of the josits. For joists spaced on five-foot centers, 24 gauge steel decking can be used. The metal decking is fastened or placed to the horizontal legs of the upper chord, for example, by welding. Typically, the reinforcing material should be welded wire fabric or rectangular mesh with an equal cross section.

Figure 4:
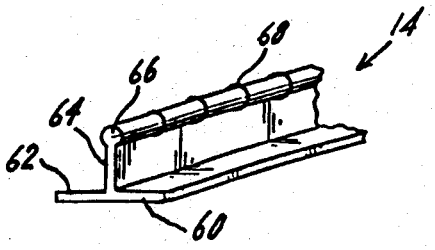
FIGS. 4 and 5 are perspective view of two other top chords which can be used in the joists of the invention.
Figure 5:
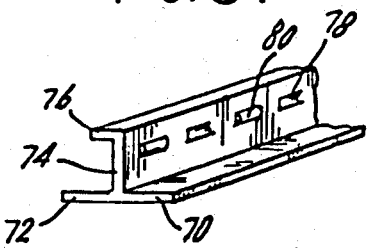

Many different types of upper chord sections 14 can be designed for use in the composite floor of this invention and it is understood that the particular configurations specifically described in this application are illustrative of such chord sections. Two examples are shown in FIGS. 4 and 5, respectively. In FIG. 4, upper chord 14 is shown to consist of a T-beam having horizontal legs 60, 62 and vertical legs 64 topped by rounded section 66. Rings 68 which act as concrete gripping means are attached at spaced intervals along the length of rounded section 66 to aid in composite action of the joist. In FIG. 5, upper chord 14 is shown to consist of a T-beam having lower horizontal legs 70, 72, a vertical leg 74 terminating in an upper horizontal leg 76. Protrusions 78, 80 are formed in opposite walls of vertical leg 74 at spaced intervals along the length of vertical leg 74.

While there has been described a presently preferred embodiments of the invention, those skilled in the art will realize that modifications and changes can be made while still coming within the scope of the invention, which is set forth in the appended claims.

What I claim is:

1. A composite concrete floor system comprising a plurality of metal joists, said joists having a top chord, a bottom chord and a web comprising tension and compression members in the space between the top and bottom chords and secured to said top and bottom chords, the top of said web being secured to the lower surface of sid top chord, said top chord having two horizontal legs and a vertical leg having a lower end and an upper end, deformations formed in the vertical leg between the upper and lower ends thereof such that there is no decrease in the height of the vertical leg along its length, said deformations extending laterally outwardly from said vertical leg, metal decking material supported between the horizontal legs of the top chords of adjacent joists, a concrete slab formed over the metal decking and the top of the joist in which the top chord is embedded with the deformations extending into said concrete slab, reinforcing mesh embedded in said concrete slab such that axial forces on said top chord which cause said deformations to act as wedges tending to split the concrete slab are counteracted by transverse restoring forces created by the reinforcing mesh.

2. The composite floor system of claim 1 wherein said deformations form arcuate projections extending from said vertical leg.

3. The composite floor system of claim 1 wherein said projections are formed approximately midway between the upper and lower ends of said vertical leg.

4. In a composite floor system including a concrete slab floor having reinforcing mesh embedded therein, a vertical member embedded in the concrete slab, said vertical member having deformations which extend outwardly from said vertical member into said concrete slab such that axial forces on said composite floor system cause said deformations to act as wedges tending to split the concrete slab counteracted by a transverse restoring forces created by the reinforcing mesh.

5. The composite floor system of claim 4 wherein said deformations form arcuate projections extending from said vertical leg.

6. The composite floor system of claim 4 wherein said vertical member has an upper and lower end and said deformations are formed approximately midway between said upper and lower end.

* * * * *